US005471184A

United States Patent [19]

Chien et al.

[11] Patent Number: 5,471,184

[45] Date of Patent: Nov. 28, 1995

[54] CIRCUIT BREAKER

[75] Inventors: Yun-Ko Chien, Murrysville; Norman L. Ovick, Pittsburgh, both of Pa.

[73] Assignee: Eaton Corporation, Cleveland, Ohio

[21] Appl. No.: 274,320

[22] Filed: Jul. 13, 1994

[51] Int. Cl.[6] ..... H01H 75/12

[52] U.S. Cl. ..... 335/35; 335/167; 335/172

[58] Field of Search ..... 335/21–25, 35, 335/167–176

[56] References Cited

U.S. PATENT DOCUMENTS

| | | | |
|---|---|---|---|
| 2,902,560 | 9/1959 | Stanback et al. | 335/35 |
| 3,815,059 | 6/1974 | Spoelman . | |
| 4,616,199 | 10/1986 | Oster | 335/35 |
| 4,630,019 | 12/1986 | Maier et al. . | |
| 4,639,701 | 1/1987 | Shimp | 335/21 |
| 4,958,136 | 9/1990 | Maier et al. . | |
| 5,250,918 | 10/1993 | Edds et al. | 335/35 |

*Primary Examiner*—Lincoln Donovan
*Attorney, Agent, or Firm*—Martin J. Moran

[57] ABSTRACT

A circuit breaker having electrical contacts operable between a closed position in which a circuit is completed through the conductor and an open position in which the circuit through the conductor is interrupted. The circuit breaker includes a latchable operating mechanism operable to open the electrical contacts when unlatched and a trip bar rotatable from a biased position to a trip position to unlatch the operating mechanism. A magnetic trip assembly is provided including a frame, a stationary magnetic structure mounted to the frame and a movable armature which is attracted to the stationary magnetic structure by abnormal current through the conductor to rotate the trip bar to a trip position. The movable armature includes a nib extending angularly therefrom, the nib defining a detent. The armature is pivotably mounted to the stationary magnetic frame by a pin. A spring biased plunger supported by the frame engages into the detent to bias the armature away from the stationary magnetic structure to form a gap therebetween. The plunger disengages from the detent when the armature is attracted to the stationary magnetic structure by the abnormal current through the conductor to allow the movable armature to rotate about the pin and trip the trip bar to interrupt the circuit.

10 Claims, 5 Drawing Sheets

CIRCUIT BREAKER

BACKGROUND OF THE INVENTION

This invention relates to an improved circuit breaker and more particularly to a circuit breaker in which the magnetic trip assembly includes an armature having a nib extending angularly therefrom, the nib having a detent which is engaged by biasing means.

Circuit breakers provide protection for electrical systems from electrical fault conditions such as current overloads and short circuits. Typically, circuit breakers include a spring powered operating mechanism which opens electrical contacts to interrupt the current through the conductors on an electrical system in response to abnormal currents. The operating mechanism is unlatched by a trip bar which in turn is operated by a trip mechanism associated with each phase of the electrical system. The trip mechanism can include a magnetic trip device comprising a fixed magnetic structure energized by the current flowing through the conductor, and a movable armature which is attracted toward the stationary magnetic structure to operate the trip bar. The trip bar in turn unlatches the operating mechanism to open the electrical contacts in each phase of the electrical system. The movable armature is biased away from the stationary magnetic structure by a spring, called a torsion spring, thereby forming a gap between the armature and the stationary magnetic structure in the absence of an abnormal current.

Several different types of adjustment means have been suggested for adjusting the level of current which the magnetic trip device actuates the operating mechanism. One such adjustment is to vary the spring bias applied to the armature by the torsion spring. However, the torsion spring is placed in the circuit breaker, and the circuit breaker is enclosed by the molded case. Thus, it is difficult to adjust the torsion spring or replace it once the case is molded. Also, if it is desired to place more force on the torsion spring, a spring back force is caused which can adversely effect the performance of the breaker. Finally, because the torsion spring is in the molded case and can not be adjusted, the torsion spring is not available to compensate for manufacturing and assembly variations in the other parts of the circuit breaker.

What is needed, therefore, is a circuit breaker that includes a magnetic trip assembly in which the biasing force applied to the movable armature is consistently and accurately controlled and can be calibrated and adjusted.

SUMMARY OF THE INVENTION

The improved circuit breaker of the invention has met the above need as well as others. The circuit breaker comprises electrical contacts operable between a closed position in which a circuit is completed through the conductor and an open position in which the circuit through the conductor is interrupted, a latchable operating mechanism operable to open the electrical contacts when unlatched and a trip bar rotatable from a biased position to a trip position to unlatch the operating mechanism. The circuit breaker further comprises a magnetic trip assembly including a frame, a stationary magnetic structure mounted to the frame and a movable armature which is attracted to the stationary magnetic structure by abnormal current through the conductor to rotate the trip bar to a trip position. The movable armature includes a nib extending angularly therefrom, the nib defining a detent. Pivot means are provided that pivotably mount the movable armature for rotation about a pivot axis. The magnetic trip assembly further comprises biasing means supported by the frame and engaging into the detent to bias the armature away from the stationary magnetic structure to form a gap therebetween. The biasing means disengages from the detent when the armature is attracted to the stationary magnetic structure by the abnormal current through the conductor to allow the movable armature to rotate about the pivot axis and trip the trip bar to interrupt the circuit.

BRIEF DESCRIPTION OF THE DRAWING

A full understanding of the invention can be gained from the following description of the preferred embodiment when read in conjunction with the accompanying drawings in which.

DETAILED DESCRIPTION

Figure 1:
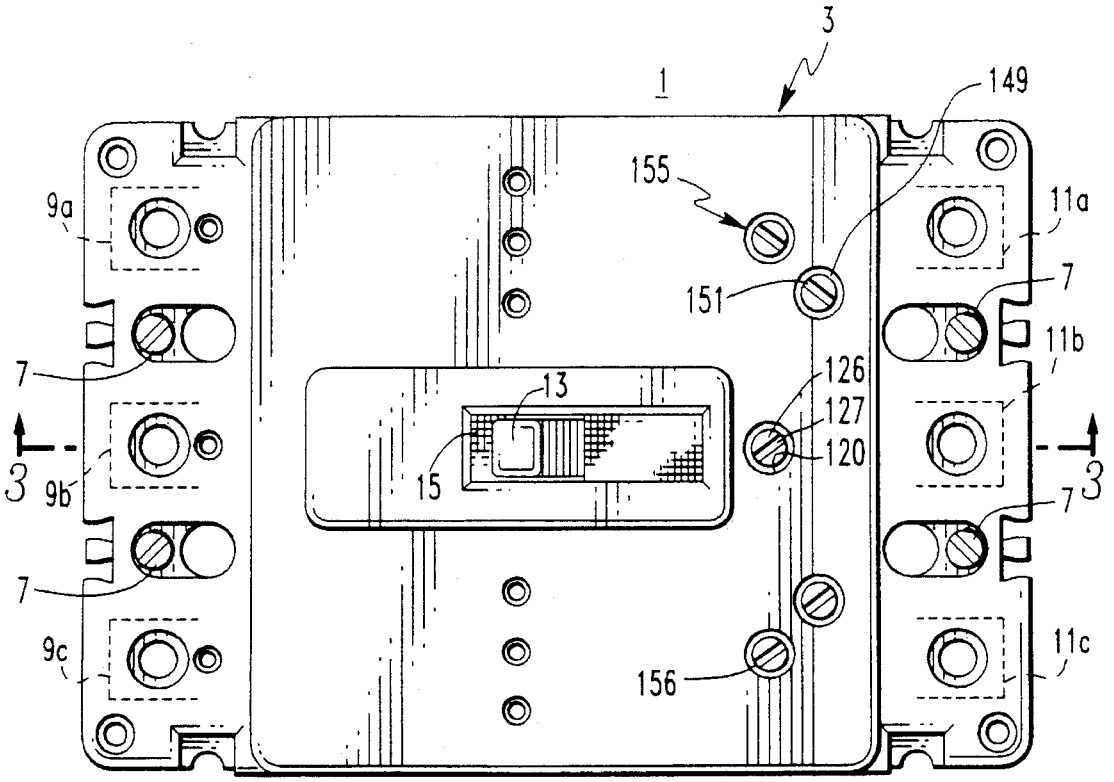
FIG. 1 is a top plan view of a circuit breaker incorporating the invention.
Figure 2:
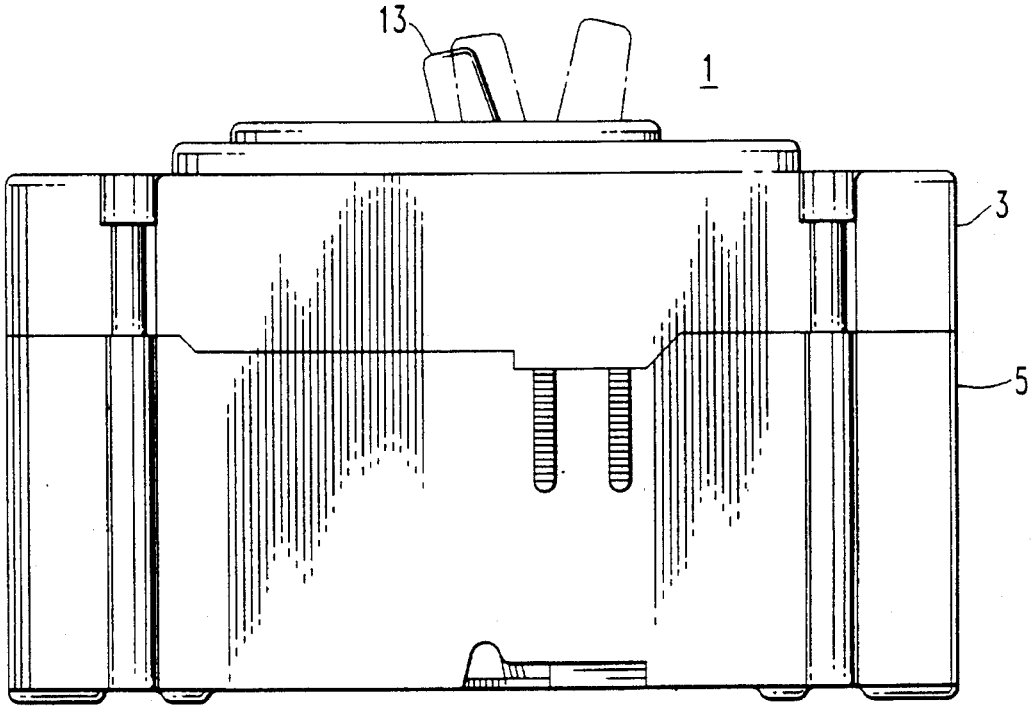
FIG. 2 is a side elevation view of the circuit breaker of FIG. 1.

Referring to the drawings, there is illustrated a molded case circuit breaker 1 incorporating a magnetic trip assembly with the improved means of controlling and calibrating the trip set point in accordance with the invention.

While the circuit breaker 1 is depicted and described herein as a three-phase, or three-pole circuit breaker, the principles of the invention are equally applicable to single phase or polyphase circuit breakers, and to both ac and dc circuit breakers.

The circuit breaker 1 includes a molded, electrically insulating, top cover 3 mechanically secured to a molded, electrically insulating, bottom cover or base 5 by fasteners 7. A set of first electrical terminals, or line terminals 9*a*, 9*b* and 9*c* are provided, one for each pole or phase. Similarly, a set of second electrical terminals, or load terminals 11*a*, 11*b* and 11*c* are provided at the other end of the circuit breaker base 5. These terminals are used to serially electrically connect circuit breaker 1 into a three-phase electrical circuit for protecting a three-phase electrical system.

The circuit breaker 1 further includes an electrically insulating, rigid, manually engaging handle 13 extending through an opening 15 in the top cover 3 for setting the circuit breaker 1 to its closed position or its open position. The circuit breaker 1 may also assume a tripped position. As is known, circuit breaker 1 may be reset from the tripped position to the closed position for further protective operation by moving the handle 13 through the open position. The handle 13 may be moved either manually or automatically by an operating mechanism 21 (FIG. 3) to be described in more detail. Preferably, an electrically insulating strip 17 (FIG. 3), movable with the handle 13, covers the bottom of the opening 15, and serves as an electrical barrier between the interior and the exterior of the circuit breaker 1.

Figure 3:
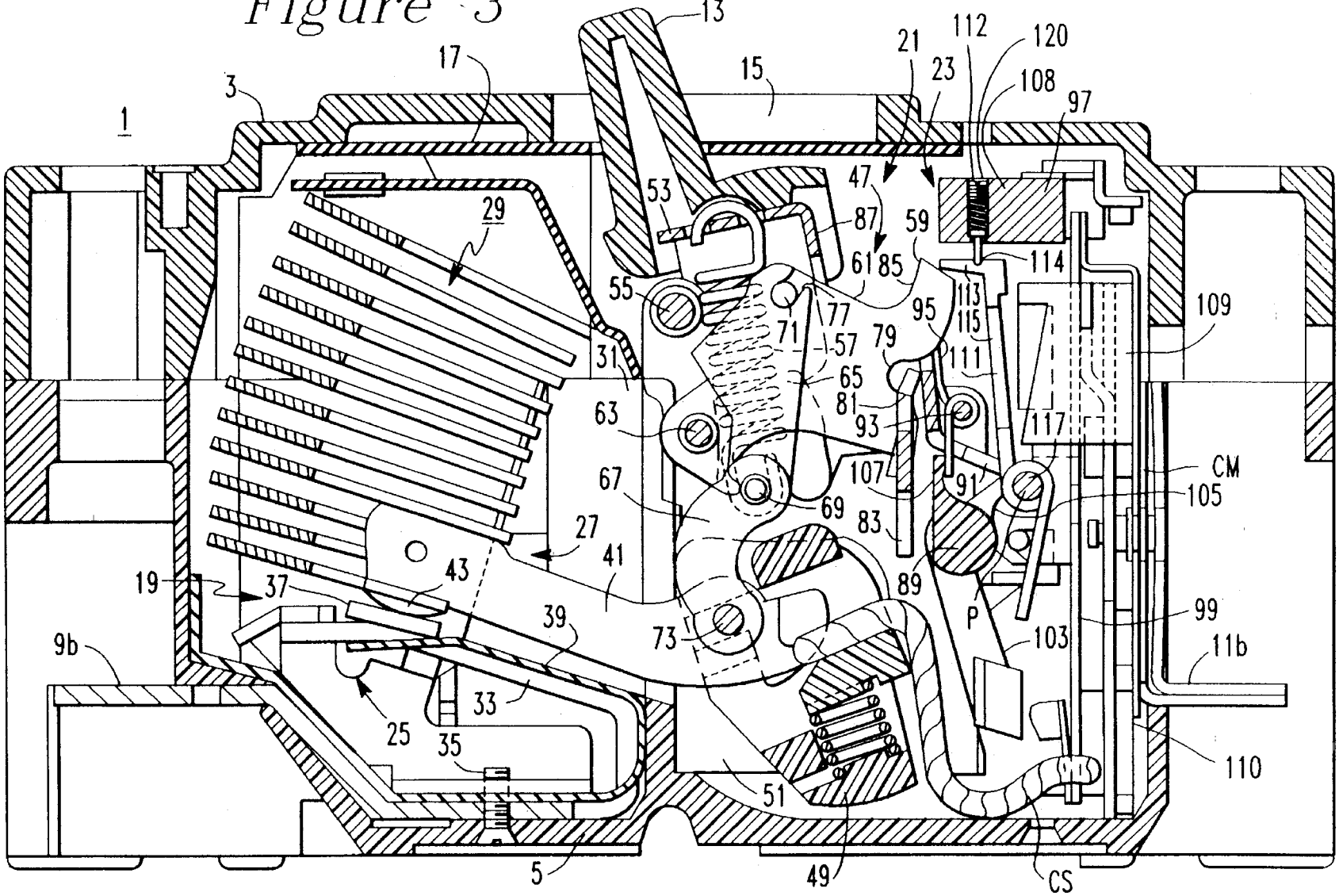
FIG. 3 is an enlarged vertical section through the circuit breaker of FIG. 1 taken along the line 3—3 in FIG. 1 and illustrating the circuit breaker in the closed position.

Referring now to FIG. 3, as its major internal components, the circuit breaker 1 includes a set of electrical contacts 19 for each phase, an operating mechanism 21 and a trip mechanism 23. Each set of electrical contacts includes a lower electrical contact 25 and an upper electrical contact 27. Associated with each set of electrical contacts 19 are an arc chute 29 and a slot motor 31 both of which are conventional. Briefly, the arc chute 29 divides a single electrical arc formed between separating electrical contacts 25 and 27 upon a fault condition into a series of electrical arcs, increasing the total arc voltage and resulting in a limiting of the magnitude of the fault current. The slot motor 31, consisting of either of a series of generally U-shaped steel lamination encased in electrical insulation or of a generally U-shaped electrically insulated, solid steel bar, is disposed about the contacts 25, 27, to concentrate the magnetic field generated upon a high level short circuit or fault current condition thereby greatly increasing the magnetic repulsion forces between the separating electrical contacts 25 and 27 to rapidly accelerate their separation. The rapid separation of the electrical contacts 25 and 27 results in a relatively high arc resistance to limit the magnitude of the fault current. A more detailed description of the arc chute 29 and slot motor 31 can be found in U.S Pat. No. 3,815,059, which is expressly incorporated by reference herein.

The lower electrical contact 25 includes a U-shaped stationary member 33 secured to the base 5 by a fastener 35, a contact 37 for physically and electrically contacting the upper electrical contact 27 and an electrically insulating strip 39 to reduce the possibility of arcing between the upper electrical contact 27 and portions of the lower electrical contact 25. The line terminal **9*b* extending exteriorly of the base 5 comprises an integral end portion of the member 33**.

The upper electrical contact 27 includes a rotatable contact arm 41 and a contact 43 for physically and electrically contacting the lower electrical contact 25.

The operating mechanism 21 includes an over-center toggle mechanism 47, an integral one-piece molded cross bar 49, a pair of rigid, spaced apart, metal side plates 51, a rigid, pivotable metal handle yoke 53, a rigid stop pin 55, a pair of operating tension springs 57 and a latching mechanism 59.

The over-center toggle mechanism 47 includes a rigid, metal cradle 61 that is rotatable about the longitudinal central axis of a cradle support pin 63 journalled in the side plates 51.

The toggle mechanism 47 further includes a pair of upper toggle links 65, a pair of lower toggle links 67, a toggle spring pin 69 and an upper toggle link follower pin 71. The lower toggle links 67 are secured to either side of the rotatable contact arm 41 of the upper electrical contact 27 by toggle contact pin 73. The ends of the pin 73 are received and retained in the molded cross bar 49. Thus, movement of the upper electrical contact 27, and the corresponding movement of the cross bar 49 are effected by movement of the lower toggle links 67. In this manner, movement of the upper electrical contact 27 by the operating mechanism 21 in the center pole or phase of the circuit breaker 1 simultaneously, through the rigid cross bar 49, causes the same movement in the electrical contacts 27 associated with the other poles or phases of the circuit breaker 1.

The upper toggle links 65 and lower toggle links 67 are pivotably connected by the toggle spring pins 69. The operating tension springs 57 are stretched between the toggle spring pin 69 and the handle yoke 53 such that the springs 57 remain under tension, enabling the operating of the over-center toggle mechanism 47 to be controlled by and be respective to external movement of the handle 13.

The upper links 65 also include recesses or grooves 77 for receipt and retention of pin 71. Pin 71 passes through the cradle 61 at a location spaced by a predetermined distance from the axis of rotation of the cradle 61. Spring tension from the springs 57 retains the pin 71 in engagement with the upper toggle links 65. Thus, rotational movement of the cradle 61 effects a corresponding movement or displacement of the upper portions of the links 65.

The cradle 61 has a slot or groove 79 defining a flat latch surface which is configured to engage a flat cradle latch surface formed in the upper end of an elongated slot or aperture 81 in a generally flat intermediate latch plate 83. The cradle 61 also includes a generally flat handle yoke contacting surface 85 configured to contact a downwardly depending, elongated surface 87 formed on the upper end of the handle yoke 53. The operating springs 57 move the handle 13 during a trip operation and the surfaces 85 and 87 locate the handle 13 in the tripped position intermediate the closed position and the open position of the handle 13, to indicate that the circuit breaker 1 has tripped. In addition, the engagement of the surfaces 85 and 87 resets the operating mechanism 21 subsequent to a trip operation by moving the cradle 61 in a clockwise direction against the bias of the operating springs 57 from its tripped position to and past its open position to enable the relatching of the latching surfaces on groove 79 and in aperture 81.

Further details of the operating mechanism and its associated molded cross bar 49 can be gained from the description of the similar operating mechanism disclosed in U.S. Pat. No. 4,630,019, which is expressly incorporated by reference herein.

The trip mechanism 23 includes the intermediate latch plate 83, a molded one-piece trip bar 89, a cradle latch plate 91, a torsion spring support pin 93, a double acting torsion spring 95, a magnetic trip assembly 97 and a thermal trip device 99 in the form of a bimetal.

The molded one-piece trip bar 89 is journalled in vertical partitions (not shown) in the base 5 of the molded case circuit breaker i which separate three poles of the circuit breaker. The trip bar 89 has actuating levers 103 for each pole extending radially downward. A trip lever 105 extending outwardly from the trip bar is engaged by the cradle latch plate 91. Cradle latch plate 91 is mounted for rotation about an axis parallel to the trip bar. One arm of the double acting torsion spring 95 biases the cradle latch plate 91 against the intermediate latch plate 81. The other arm of the torsion spring 95 bears against a vertical projection 107 on the trip bar 89 to bias the trip bar in the counter clockwise direction as viewed in FIG. 3.

With the circuit breaker in the closed position as shown in FIG. 3, the tension springs 57 tend to rotate the cradle 61 in the counter clockwise direction. This is resisted, however, by the cradle latch plate 91 held in place by the trip lever 105 on the trip bar 89 and acting through the intermediate latch plate 83.

A current bearing conductive path between the lower end of the bimetal 99 and the upper electrical contact 27 is achieved by a flexible copper shunt CS connected by any suitable means, for example by brazing to the lower end of the bimetal 99 and to the upper electrical contact 27 within the cross bar 49. In this manner, an electrical path is provided through the circuit breaker 30 between the terminals 9*b* and 11*b* via the lower electrical contact 25, the upper electrical contact 27, the flexible shunt 106, the bimetal 99, and the conductive member CM.

The magnetic trip assembly 97 includes an adjustment bar 108, a stationary magnetic structure 109, a frame 110 to which the stationary magnetic structure 109 is mounted, a movable armature 111 and biasing means 112 which will be described in detail below with respect to FIGS. 4–7. The armature 111 includes a nib 113 extending angularly therefrom, the nib defining a detent 114. The remaining portion of the armature 111 is bent along a horizontal axis and slotted at 115 for receipt of a pin 117 about which the armature is pivotably mounted for rotation about a pivot axis P. The biasing means 112 is disposed in an accessed through access hole 120 in the adjustment bar 108.

Figure 4:
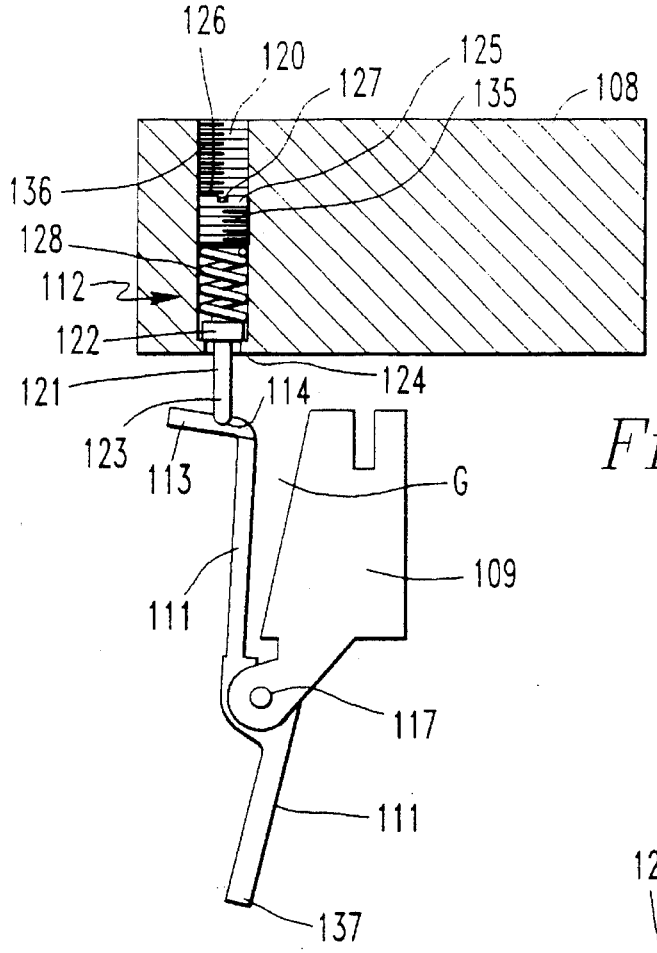
FIG. 4 is a detailed vertical sectional view of the magnetic trip assembly in the normal (non-tripped) position showing the nib of the armature extending at an angle of greater than 90° from the armature.

Referring now to FIG. 4, a detailed description of the magnetic trip assembly 97 will follow. FIG. 4 shows the so-called non-trip position wherein a gap G is formed between the armature 111 and the stationary magnetic structure 109.

The biasing means 112 consists of a plunger 121 having a first portion 122 disposed in the access hole 120 defined by the adjustment bar 108 and a second portion 123 which projects from the adjustment bar 108 to engage into the detent 114 defined by the nib 113 of the armature 111. The first portion 122 of the plunger 121 is retained in the adjustment bar 108 by means of an integral annular retaining lip 124. A non-metallic set screw 125 is threadedly engaged in the access hole 120 and is adapted to be moved up and down in the access hole. The set screw 125 has an upper portion 126 which defines a channel 127 that can be engaged by a screwdriver or other rotating tool (not shown) to move the set screw 125 up or down in the access hole 120. A spring 128 is disposed between the plunger 121 and the set screw 125.

It will be appreciated that by adjusting the set screw 125, varying amounts of force can be applied by the plunger 121 on the detent 114. This permits separate calibration of each pole of the circuit breaker 1 when completely assembled. The calibration is performed on the assembly line and once the calibration is completed, preferably the access holes 120 are plugged. The preloaded force of the plunger 121 on the detent 114 is calibrated to equal and counteract the desired magnetic force magnitude created by an abnormal current through the circuit breaker 1 to create a desired trip setting. When an abnormal current exceeds this trip setting, the magnetic force of the current exceeds the counteracting spring force of the plunger 121 in the detent 114. Each phase of the circuit breaker can be independently calibrated for desired trip settings.

The threads 135 on the set screw are very fine to obtain an increase in the sensitivity of the calibration. Additionally, the fit on the threads between the set screw threads 135 and the access hole threads 136 are very tight in order to resist any movement of the set screw 125 therein due to vibration or shock of the circuit breaker 1.

The spring 128 has a spring constant that determines the amount of force that the plunger 121 exerts into the detent 114. It will be appreciated that different springs, with different spring constants can be used in order to vary the force applied by the spring to the plunger 121 and ultimately into the detent 114.

It will further be appreciated that the portion of the plunger 121 that engages the detent 119, and the detent 114 itself can have different shapes, slopes and dimensions so as to adjust the engagement of one to the other. This, like the spring constant, can effect the amount of force applied between the detent 114 and the plunger 121.

When abnormal current is sufficient for the magnetic force between the armature 111 and the stationary magnetic structure 109 to exceed the spring 128 and plunger 121 preloaded force, the plunger 121 will rise out of the detent 114. At this point, there is no longer a significant restraining force on the armature 111, and all of the magnetic force can be applied to tripping the circuit breaker and the armature 111 will rotate clockwise as shown in FIG. 4. This, in turn will rotate the bottom portion 137 clockwise to then, in turn, rotate the trip bar 89 (FIG. 3) and trip the breaker. FIG. 4 shows the armature 111 attracted to the stationary magnetic structure 109. The nib 113 of the armature 111 still maintains contact with the plunger 121. Once the current is interrupted and the magnetic field collapses, the downward force of the spring 128 on the plunger 121 causes the armature 111 to rotate counterclockwise (towards the left on FIG. 5) and back to the non-trip position shown in FIG. 4 wherein the plunger 121 engages into the detent 114. In this way, the armature 111 is automatically reset to the non-trip position. It will be appreciated that the angle B at which the nib 113 extends from the armature 111 must be greater than 90° in this automatically resetting embodiment.

Figure 5:
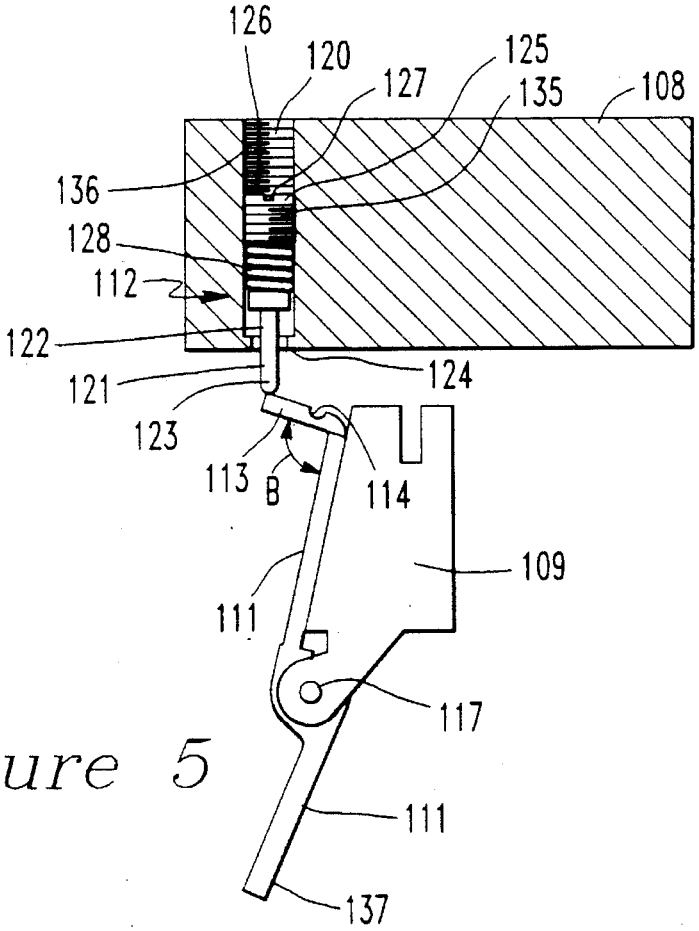
FIG. 5 is a detailed vertical sectional view of the magnetic, trip assembly shown in FIG. 4 in the tripped position.
Figure 6:
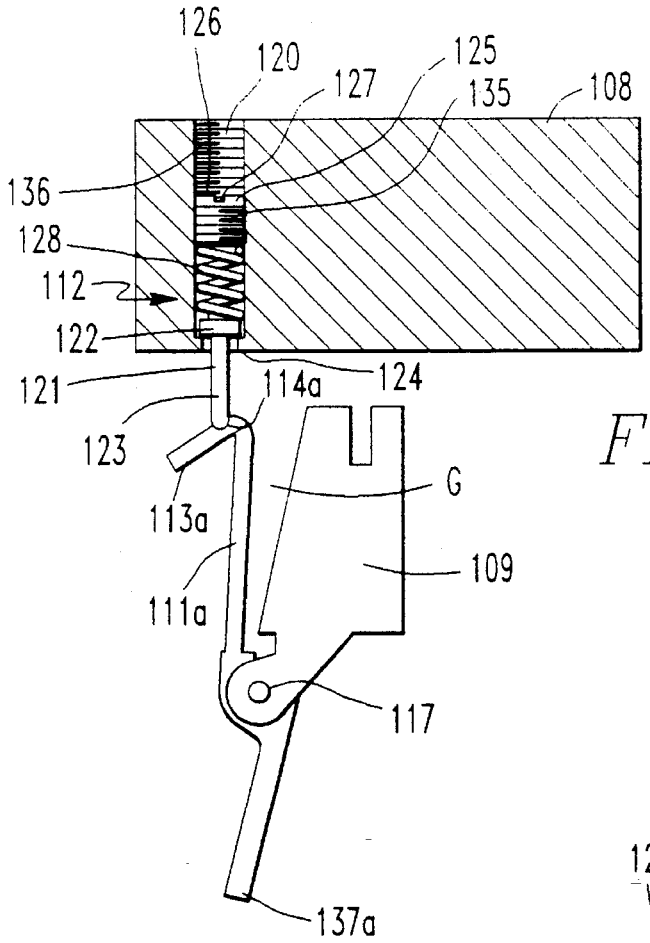
FIG. 6 is a detailed vertical sectional view similar to FIG. 4 only showing the nib of the armature extending at an angle of less than 90° from the armature, with the armature being in the normal (non-tripped) position.
Figure 7:
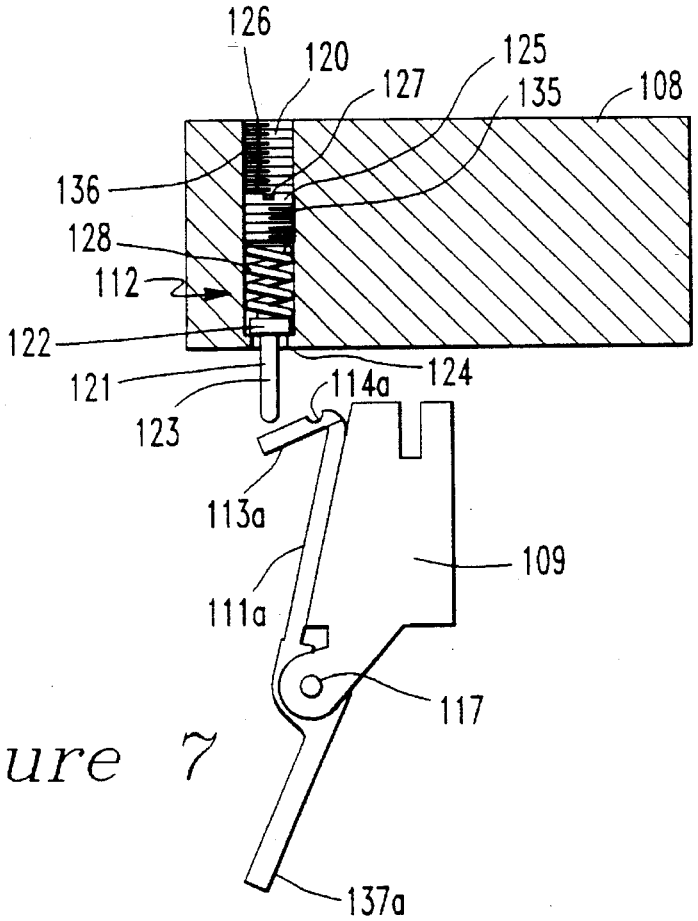
FIG. 7 is detailed vertical sectional view of the magnetic trip assembly shown in FIG. 6 with the armature being in the tripped position.

Referring now to FIGS. 6 and 7, where like reference numbers to FIGS. 4 and 5 indicate like structures, the nib 113*a* extends at an angle less than 90° from the remainder of the armature 111*a*. Not only does this decrease the amount of force necessary to lift plunger 121 from detent 114*a*, it also means that the armature 111*a* does not automatically reset after being attracted to the stationary magnetic structure 109, and after the current is interrupted and the magnetic field collapses. Referring to FIG. 7, due to the geometry of the nib 113*a* with respect to the armature 111*a* and the plunger 121, the plunger 121 may not contact, but in some instances may contact, the nib 113*a* once the armature 111*a* is attracted to the stationary magnetic structure 109. It is noted that the compressed spring adds to the magnetic force when out of the detent 113. This assists in the force needed to have the armature 111 move towards the stationary magnetic structure 109 when an abnormal current is present. Because of this, there is no "snap action" to draw the armature 111*a* back to the set position as shown in FIG. 6. In this case, the armature must be reset manually by the user using a special tool that can allow the user access to the armature 111*a* through the molded circuit breaker case.

Figure 8:
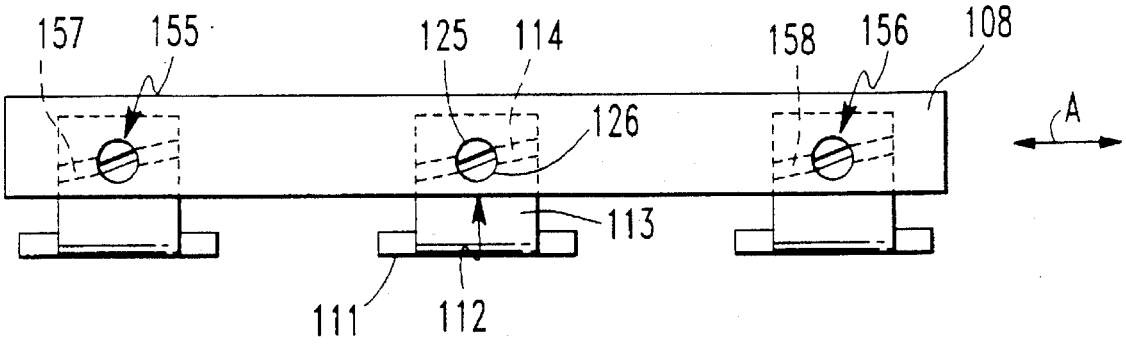
FIG. 8 is a partial top plan view showing the adjustment bar.

Referring now to FIG. 8, the adjustment bar means of the invention will be discussed. The adjustment bar 108 allows the three poles of the breaker to be adjusted simultaneously as opposed to calibration where each of the poles is set individually. Typically, the current trip point is adjusted between 5x and 10x. The adjustment of the adjustment bar 108 is accomplished by rotatable camming mechanism 149 (FIG. 1) which is mounted to the circuit breaker and which is accessible through the cover 3 to provide means for adjusting the position of the adjustment bar 108 without removing the cover 5. Details of the operation of the adjustment bar 108 are found in U.S. Pat. No. 4,958,136, which is hereby incorporated by reference herein.

Rotation of the camming device 149 by insertion of a tool such as a screwdriver into slot 151 provides the capability of rectilinearly moving the adjustment bar 108 longitudinally. The plunger 121 of biasing means 112, along with the plungers (not shown) of biasing means 155 and 156 associated with the other poles of the circuit breaker 1, are moved simultaneously when the camming device 149 is rotated. Since the plungers engage into the detents, the plungers will follow a path defined by the detents. As can be seen in FIG. 8, the detents 114, 157 and 158 are skewed from the axis A of the rectilinear motion of the adjustment bar 108 and the axis of the trip bar 89 (see FIG. 3), axis A and the axis of the trip bar 89 being generally parallel. Thus, moving the plungers along the detent 114, 157, 158 causes the air gap G (see FIG. 4) to change size. This in turn causes the magnetic force on the armature to change for a given current. It will be appreciated that changing the skewing of the detents relative to the axis of rectilinear motion of the adjustment bar 108 will alter the range of the gaps G between the armature 111 and the stationary magnetic structure 109.

It will be appreciated that a circuit breaker has been disclosed which provides protection for electrical systems from electrical fault conditions such as current overloads and short circuits.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker for responding to abnormal currents in a conductor in an electrical system, said circuit breaker comprising:

electrical contacts operable between a closed position in which a circuit is completed through said conductor and an open position in which said circuit through said conductor is interrupted;

a latchable operating mechanism operable to open said electrical contacts when unlatched;

a trip bar rotatable from a biased position to a trip position to unlatch said operating mechanism; and a magnetic trip assembly comprising:

a frame;

a stationary magnetic structure mounted to said frame;

a movable armature which is attracted to said stationary magnetic structure by said abnormal current through said conductor to rotate said trip bar to a trip position, said movable armature including a nib extending angularly therefrom, said nib defining a detent;

pivot means pivotably mounting said movable armature for rotation about a pivot axis; and biasing means supported by said frame and engaging into said detent to bias said armature away from said stationary magnetic structure to form a gap therebetween, said biasing means disengaging from said detent when said armature is attracted to said stationary magnetic structure by said abnormal current through said conductor to allow said movable armature to rotate about said pivot axis and trip said trip bar to interrupt said circuit.

2. The circuit breaker of claim 1, wherein said nib extends from said armature at an angle of greater than 90° so that after said circuit breaker has been tripped, said biasing means causes said armature to move away from said stationary magnetic structure and said biasing means to reengage into said detent.

3. The circuit breaker of claim 1, wherein said nib extends from said armature at an angle of less than about 90° so that after said circuit breaker has been tripped, said armature must be manually moved away from said stationary magnetic structure in order to reengage said biasing means into said detent.

4. The circuit breaker of claim 1, wherein said biasing means includes (i) a plunger having a first portion disposed in said frame and a second portion projecting from said frame to engage into said detent; (ii) a set screw disposed in said frame and (iii) a spring disposed between said plunger and said set screw, wherein the amount of force applied by said plunger on said detent can be controlled by adjustment of said set screw so that said circuit breaker can be calibrated for a desired trip setting.

5. The circuit breaker of claim 1, wherein said detent is formed as a channel that traverses said nib, said channel being skewed relative to said pivot axis wherein rectilinear movement of said plunger generally parallel to said pivot axis adjusts said gap.

6. The circuit breaker of claim 1, including a molded case in which said electrical contacts, latchable operating mechanism, trip bar and magnetic trip assembly are housed such that said biasing means cannot be accessed without opening said molded case.

7. A circuit breaker for responding to abnormal currents in conductors associated with each phase in a multiphase electrical system comprising:

a set of electrical contacts for each phase of said multiphase electrical system completing an electrical circuit through an associated conductor when closed and interrupting said electrical circuit when opened;

a latchable operating mechanism operable to open all of said sets of said electrical contacts when unlatched;

a trip bar rotatable from a biased position to a trip position to unlatch said operating mechanism;

a magnetic trip assembly for each phase of said multiphase electrical system, each magnetic trip assembly comprising:

a frame;

a stationary magnetic structure mounted to said frame;

a movable armature which is attracted to said stationary magnetic structure by said abnormal current through said conductor to rotate said trip bar to a trip position, said movable armature including a nib extending angularly therefrom, said nib defining a detent;

pivot means pivotably mounting said movable armature for rotation about a pivot axis; and biasing means supported by said frame and engaging into said detent to bias said movable armature away from said stationary magnetic structure to form a gap therebetween, said biasing means disengaging said detent when said movable armature is attracted to said stationary magnetic structure by said abnormal current through said conductor;

said detent is formed as a channel that traverses said nib, said channel being skewed relative to said pivot axis; and adjustment bar means mounted to at least one of said frames for simultaneously moving said biasing means rectilinearly and generally parallel to said pivot axis wherein said gap between each said armature and each said stationary magnetic structure is adjusted simultaneously.

8. The circuit breaker of claim 7, wherein said pivot axes of said armatures are axially aligned; and said adjusting means is an adjustment bar slidable rectilinearly in a direction generally parallel to said pivot axes of said armatures to simultaneously adjust biasing of all of said armatures by said biasing means between a high and a low trip setting.

9. The circuit breaker of claim 8, including a molded case in which said sets of electrical contacts, operating mechanism, trip bar, magnetic trip assemblies and adjusting means are housed; and rotatable range setting means connected to translate rotation thereof into said rectilinear sliding of said adjustment bar, said rotatable range settings being accessible through said molded case such that biasing of said armatures over said range between said high and low trip settings can be effected without opening said molded case.

10. The circuit breaker of claim 7, wherein said biasing means includes (i) a plunger having a first portion disposed in said frame and a second portion projecting from said frame to engage into said detent; (ii) a set screw disposed in said frame and (iii) a spring disposed between said plunger and said set screw, wherein the amount of force applied by said plunger on each detent can be controlled by adjustment of each individual set screw so that each individual circuit breaker can be calibrated for a desired setting.

* * * * *